United States Patent [19]

Matsumoto et al.

[11] Patent Number: 4,936,926

[45] Date of Patent: Jun. 26, 1990

[54] METHOD FOR MANUFACTURING STEEL ARTICLE HAVING HIGH TOUGHNESS AND HIGH STRENGTH

[75] Inventors: Kazuaki Matsumoto; Shinichi Suzuki; Hisatoshi Tagawa, all of Tokyo, Japan

[73] Assignee: NKK Corporation, Tokyo, Japan

[21] Appl. No.: 261,241

[22] Filed: Oct. 21, 1988

[30] Foreign Application Priority Data

Oct. 29, 1987 [JP] Japan ..... 62-271667

[51] Int. Cl.[5] ..... C21D 8/00

[52] U.S. Cl. ..... 148/12 F; 148/12.4

[58] Field of Search ..... 148/12 F, 12.4

[56] References Cited

U.S. PATENT DOCUMENTS 4,584,032 4/1986 Isokawa et al. ..... 148/12 F

FOREIGN PATENT DOCUMENTS 1182721 2/1985 Canada ..... 148/12 F
0191873 8/1986 European Pat. Off. .
3007560 9/1981 Fed. Rep. of Germany .
2296017 7/1976 France .
2333047 6/1977 France .
56-133418 10/1981 Japan ..... 148/12 F
58-171526 10/1983 Japan ..... 148/12 F
59-100256 6/1984 Japan .
60-103161 6/1985 Japan .
61-19761 1/1986 Japan .
61-139646 6/1986 Japan .
1116254 6/1968 United Kingdom .
2163454 2/1986 United Kingdom .

*Primary Examiner*—Deborah Yee
*Attorney, Agent, or Firm*—Frishauf, Holtz Goodman & Woodward

[57] ABSTRACT

A method for manufacturing a steel article having a high toughness and a high strength, which comprises the steps of:

using a material comprising:
carbon: from 0.020 to 0.049 wt. %,
silicon: from 0.10 to 1.00 wt. %,
manganese: from 1.00 to 3.50 wt. %,
chromium: from 0.50 to 3.50 wt. %,
where the total amount of manganese and chromium being from 2.50 to 6.00 wt. %,
vanadium: from 0.02 to 0.20 wt. %,
aluminum: from 0.01 to 0.05 wt. %, and the balance being iron and incidental impurities, where, the amount of nitrogen as one of the incidental impurities being up to 0.006 wt. %;

heating the material to the austenization temperature region;

hot-working the material in the austenization temperature region to prepare a steel article; and cooling the steel article thus prepared from the austenization temperature region to a temperature of or lower than 300° C. at a cooling rate of from 2° to 100° C./second, thereby imparting a high toughness and a high strength to the steel article.

9 Claims, 2 Drawing Sheets

METHOD FOR MANUFACTURING STEEL ARTICLE HAVING HIGH TOUGHNESS AND HIGH STRENGTH

As far as we know, there are available the following prior art documents pertinent to the present invention:

(1) Japanese Patent Provisional Publication No. 59-100,256 dated June 9, 1984;

(2) Japanese Patent Provisional Publication No. 60-103,161 dated June 7, 1985;

(3) Japanese Patent Provisional Publication No. 61-19,761 dated Jan. 28, 1986; and (4) Japanese Patent Provisional Publication No. 61-139,646 dated June 26, 1986.

The contents disclosed in the above-mentioned prior art documents will be discussed under the heading of the "BACKGROUND OF THE INVENTION" hereafter.

FIELD OF THE INVENTION

The present invrntion relates to a method for manufacturing a steel article having a high toughness and a high strength.

BACKGROUND OF THE INVENTION

Mechanical parts such as automobile parts are usually manufactured by hot-forging a steel bar to prepare mechanical parts having a prescribed shape, and then applying a refining heat treatment comprising hardening and tempering, to the thus prepared mechanical parts.

The above-mentioned refining heat treatment, which is applied for the purpose of imparting desired toughness and strength to the mechanical parts, requires largescale facilities and a huge thermal energy. If, therefore, the above-mentioned refining heat treatment can be omitted from the manufacturing process of the mechanical parts, it would permit simplification of the facilities and saving of thermal energy.

As a steel bar not requiring the above-mentioned refining heat treatment after preparation of a steel article, i.e., as a non-refining steel bar, the following ones have conventionally been proposed:

(1) A non-refining steel bar, disclosed in Japanese Patent Provisional Publication No. 59-100,256 dated June 9, 1984, which comprises:

carbon: from 0.20 to 0.40 wt. %,
silicon: from 0.01 to 1.50 wt. %,
manganese: from 0.8 to 2.0 wt. %,
vanadium: from 0.01 to 0.20 wt. %,
nitrogen: from 0.002 to 0.025 wt. %,
aluminum: from 0.001 to 0.05 wt. %,
sulfur: up to 0.05 wt. %,
titanium/nitrogen: from 0.2 to 2.5, and the balance being iron and incidental impurities (hereinafter referred to as the "Prior Art 1").

(2) A non-refining steel bar, disclosed in Japanese Patent Provisional Publication No. 60-103,161 dated June 7, 1985, which comprises:

carbon: from 0.05 to 0.15 wt. %,
silicon: from 0.10 to 1.00 wt. %,
manganese: from 0.60 to 3.00 wt. %,
aluminum: from 0.01 to 0.05 wt. %, where, the total amount of manganese and chromium being from 2.20 to 5.90 wt. %, and the balance being iron and incidental impurities (hereinafter referred to as the "Prior Art 2").

(3) A non-refining steel bar, disclosed in Japanese Patent Provisional Publication No. 61-19,761 dated Jan. 28, 1986, which comprises:

carbon: from 0.05 to 0.18 wt. %,
silicon: from 0.10 to 1.00 wt. %,
manganese: from 0.60 to 3.00 wt. %,
titanium: from 0.010 to 0.030 wt. %,
boron: from 0.0005 to 0.0030 wt. %,
aluminum: from 0.01 to 0.05 wt. %,
nitrogen: up to 0.0060 wt. %, where the total amount of manganese and chromium being from 1.60 to 4.20 wt. %, and the balance being iron and incidental impurities (hereinafter referred to as the "Prior Art 3").

(4) A non-refining steel bar, disclosed in Japanese Patent Provisional Publication No. 61-139,646 dated June 26, 1986, which comprises:

carbon: from 0.06 to 0.15 wt. %,
silicon: from 0.10 to 1.00 wt. %,
manganese: from 0.50 to 2.00 wt. %,
titanium: from 0.010 to 0.030 wt. %,
boron: from 0.0005 to 0.0030 wt. %,
aluminum: from 0.01 to 0.05 wt. %, where, the total amount of manganese and chromium being from 2.00 to 4.00 wt. %, and the balance being iron and incidental impurities (hereinafter referred to as the "Prior Art 4").

The above-mentioned Prior Arts 1 to 4 have the following problems. More particularly, in the Prior Art 1, which permits achievement of a higher strength by adding vanadium and of a higher toughness by adding titanium, the high carbon content of from 0.20 to 0.40 wt. % imposes a limit in increasing toughness. In the Prior Arts 2, 3 and 4, which permit achievement of a higher strength as compared with the Prior Art 1, toughness is equal or inferior to that in the Prior Art 1. Particularly in the Prior Art 4, the high carbon content of from 0.06 to 0.15 wt. % poses difficulties in toughness.

Under such circumstances, there is a strong demand for development of a method for manufacturing a steel article having a higher toughness and a higher strength than in the above-mentioned Prior Arts 1 to 4, i.e., having a toughness including a Charpy impact value at 25° C. (uE25° C.) of at least 15.0 kgf.m/cm$^2$ and a Charpy impact value at −40° C. (uE−40° C.) of at least 10 kgf.m/cm$^2$ and having a strength including a yield strength (YS) of at least 60 kgf/mm$^2$ and a tensile strength (TS) of at least 80 kgf/mm$^2$, but such a method has not as yet been proposed.

SUMMARY OF THE INVENTION

An object of the present invention is therefore to provide a method for manufacturing a steel article having a toughness including a Charpy impact value at 25° C. (uE25° C.) of at least 15.0 kgf.m/cm$^2$ and a Charpy impact value at −40° C. (uE−40° C.) of at least 10 kgf.m/cm$^2$ and having a strength including a yield strength (YS) of at least 60 kgf/mm$^2$ and a tensile strength (TS) of at least 80 kgf/mm$^2$.

In accordance with one of the features of the present invention, there is provided a method for manufacturing a steel article having a high toughness and a high strength, characterized by comprising the steps of:

using a material comprising:

carbon: from 0.020 to 0.049 wt. %, silicon: from 0.10 to 1.00 wt. %, manganese: from 1.00 to 3.50 wt. %, chromium: from 0.50 to 3.50 wt. %, where, the total amount of said manganese and said chromium being from 2.50 to 6.00 wt. %, vanadium: from 0.02 to 0.20 wt. %, aluminum: from 0.01 to 0.05 wt. %, and the balance being iron and incidental impurities, where, the amount of nitrogen as one of said incidental impurities being up to 0.006 wt. %;

heating said material to the austenization temperature region;

hot-working said material in the austenization temperature region to prepare a steel article; and cooling said steel article thus prepared from the austenization temperature region to a temperature of or lower than 300° C. at a cooling rate of from 2 to 100° C./second, thereby imparting a high toughness and a high strength to said steel article.

Said material may further additionally contain as required the following elements:

boron: from 0.0003 to 0.0030 wt. %, and titanium: from 0.005 to 0.030 wt. %.

Said material may further additionally contain as required at least one element selected from the group consisting of:

nickel: from 0.05 to 1.00 wt. %, copper: from 0.05 to 1.00 wt. %, molybdenum: from 0.05 to 0.50 wt. %, and niobium: from 0.005 to 0.050 wt. %.

DETAILED DESCRIPTION OF PREFERRED EMBODIMENTS

Figure 1:
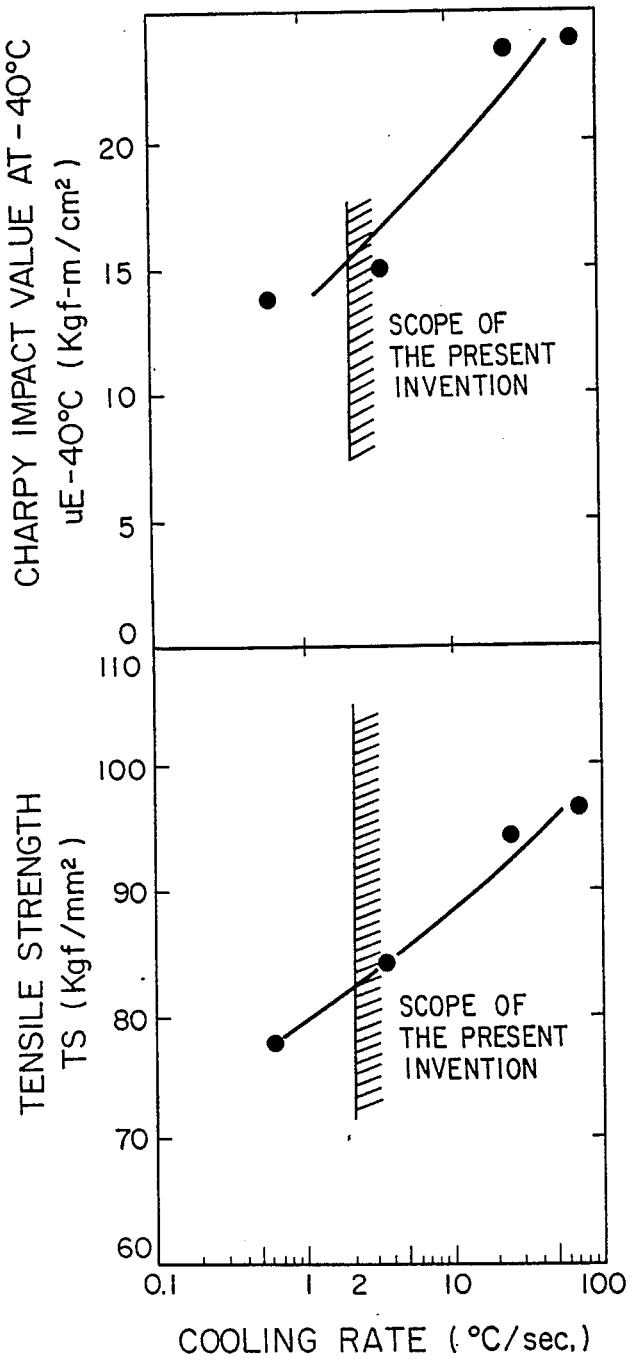
FIG. 1 is a graph illustrating the relationship between Charpy impact value at −40° C., tensile strength, and the cooling rate for a test piece made of steel (A)

From the above-mentioned point of view, we carried out extensive studies to develop a method for manufacturing a steel article having a higher toughness and a higher strength than in the Prior Arts 1 to 4 as described above. As a result, there was obtained the finding that it is possible to manufacture a steel article having a higher toughness and a higher strength than in the above-mentioned Prior Arts 1 to 4 by using a material having a reduced carbon content for a steel article; heating this material to the austenization temperature region; hot-working the material in the above-mentioned austenization temperature region to prepare a steel article; and cooling the steel article thus prepared from the austenization temperature region to a prescribed temperature or under at a cooling rate within a certain range.

The present invention was achieved on the basis of the above-mentioned finding. The method for manufacturing a steel article having a high toughness and a high strength of the present invention comprises the steps of: using a material comprising:

carbon: from 0.020 to 0.049 wt. %, silicon: from 0.10 to 1.00 wt. %, manganese: from 1.00 to 3.50 wt. %, chromium: from 0.50 to 3.50 wt. %, where, the total amount of said manganese and said chromium being from 2.50 to 6.00 wt. %, vanadium: from 0.02 to 0.20 wt. %, aluminum: from 0.01 to 0.05 wt. %, and the balance being iron and incidental impurities, where, the amount of nitrogen as one of said incidental impurities being up to 0.006 wt. %;

heating said material to the austenization temperature region;

hot-working said material in the austenization temperature region to prepare a steel article; and cooling said steel article thus prepared from the austenization temperature region to a temperature of or lower than 300° C. at a cooling rate of from 2 to 100 ° C./ second, thereby imparting a high toughness and a high strength to said steel article.

Said material may further additionally contain as required the following elements:

boron: from 0.0003 to 0.0030 wt. %, and titanium: from 0.005 to 0.030 wt. %.

Said material may further additionally contain as required at least one element selected from the group consisting of:

nickel: from 0.05 to 1.00 wt. %, copper: from 0.05 to 1.00 wt. %, molybdenum: from 0.05 to 0.50 wt. %, and niobium: from 0.005 to 0.050 wt. %.

Now, the following paragraphs describe the reasons why the chemical composition of the material for a steel article is limited as described above in the method for manufacturing a steel article having a high toughness and a high strength of the present invention.

(1) Carbon:

Carbon is an element having an important effect on toughness and strength. With a carbon content of under 0.020 wt. %, however, a sufficient strength cannot be obtained. With a carbon content of over 0.049 wt. %, on the other hand, a sufficient toughness cannot be obtained. Therefore, the carbon content should be limited within the range of from 0.020 to 0.049 wt. %.

(2) Silicon

Silicon has the function of deoxidation and of improving hardenability. With a silicon content of under 0.10 wt. %, however, a desired effect as described above cannot be obtained. A silicon content of over 1.00 wt. % leads on the other hand to a lower toughness. Therefore, the silicon content should be limited within the range of from 0.10 to 1.00 wt. %.

(3) Manganese:

Manganese has the function of improving toughness and strength. With a manganese content of under 1.00 wt. %, however, a desired effect as described above cannot be obtained. A manganese content of over 3.50 wt. % results on the other hand in a lower toughness. Therefore, the manganese content should be limited within the range of from 1.00 to 3.50 wt. %.

(4) Chromium:

Similarly to manganese, chromium has the function of improving toughness and strength. With a chromium content of under 0.5 wt. %, however, a desired effect as described above cannot be obtained. A chromium content of over 3.50 wt. % leads on the other hand to a lower toughness. Therefore, the chromium content should be limited within the range of from 0.5 to 3.50 wt. %.

With a total amount of chromium and manganese of under 2.50 wt. %, a sufficient strength cannot be obtained. A total amount of chromium and manganese of over 6.0 wt. % leads on the other hand to a lower toughness and a higher cost. The total amount of chromium and manganese should therefore be limited within the range of from 2.50 to 6.0 wt. %.

(5) Vanadium:

Vanadium has the function of improving strength. With a vanadium content of under 0.02 wt. %, however, a desired effect as mentioned above cannot be obtained. A vanadium content of over 0.20 wt. % leads on the other hand to a lower toughness. Therefore, the vanadium content should be limited within the range of from 0.02 to 0.20 wt. %.

(6) Aluminum:

Aluminum has a strong function of deoxidation. With an aluminum content of under 0.01 wt. %, however, a desired effect as described above cannot be obtained. Even with an aluminum content of over 0.05 wt. %, on the other hand, no further improvement in the deoxidizing effect can be expected. Therefore, the aluminum content should be limited within the range of from 0.01 to 0.05 wt. %.

(7) Nitrogen:

Nitrogen is an element inevitably entrapped into steel. Although the nitrogen content should preferably be the lowest possible, it is difficult to largely reduce the nitrogen content in an industrial scale. However, a nitrogen content of over 0.006 wt. % requires an increased amount of titanium added to fix nitrogen when additionally adding titanium, resulting in an increased amount of produced titanium nitride (TiN), which in turn leads to a further decreased toughness. Therefore, the amount of nitrogen as one of the incidental impurities should be limited up to 0.006 wt. %.

(8) Boron:

Boron has the function of improving hardenability. Boron is therefore further additionally added as required in the present invenion. With a boron content of under 0.0003 wt. %, however, a desired effect as described above cannot be obtained. Even with a boron content of over 0.0030 wt. %, on the other hand, no further improvement in hardenability is available. Therefore, the boron content should be limited within the range of from 0.0003 to 0.0030 wt. %.

(9) Titanium:

Titanium has the function of fixing nitrogen in steel to promote the hardenability improving effect provided by boron. In the present invention, therefore, titanium is further additionally added as required. With a titanium content of under 0.005 wt. %, however, a desired effect as described above cannot be obtained. With a titanium content of over 0.030 wt. %, there is no further improvement in the nitrogen fixing effect in steel. Furthermore, a titanium content of over 0.030 wt. % causes excessive production of titanium nitride (TiN), resulting in a lower toughness. Therefore, the titanium content should be limited within the range of from 0.005 to 0.030 wt. %. In order to effectively fix nitrogen in steel, it is recommended to add titanium in an amount 3.4 times the nitrogen content.

(10) Nickel:

Nickel has the function of improving toughness and strength. In the present invention, therefore, nickel is further additionally added as required. With a nickel content of under 0.05 wt. %, however, a desired effect as mentioned above cannot be obtained. A nickel content of over 1.00 wt. % leads on the other hand to a higher cost. Therefore, the nickel content should be limited within the range of from 0.05 to 1.00 wt. %.

(11) Copper:

For a reason similar to that in the case of nickel, the copper content should be limited within the range of from 0.05 to 1.00 wt. %.

(12) Molybdenum:

Molybdenum has the function of improving toughness and strength. In the present invention, therefore, molybdenum is further additionally added as required. With a molybdenum content of under 0.05 wt. %, however, a desired effect as mentioned above cannot be obtained. A molybdenum content of over 0.50 wt. % leads on the other hand to a higher cost. Therefore, the molybdenum content should be limited within the range of from 0.05 to 0.50 wt. %.

(13) Niobium:

Niobium has the function of improving strength. In the present invention, therefore, niobium is further additionally added as required. With a niobium content of under 0.005 wt. %, however, a desired effect as described above cannot be obtained. A niobium content of over 0.050 wt. % results on the other hand in a lower toughness. Therefore, the niobium content should be limited within the range of from 0.005 to 0.050 wt. %.

In addition to the elements described above, sulfur may be added in an amount of from 0.02 to 0.07 wt. %, or lead, in an amount of from 0.04 to 0.4 wt. % to improve machinability.

In the present invention, the material having the above-mentioned chemical composition is heated to the austenization temperature region for the purpose of achieving a sufficient hardening effect.

In the present invention, the above-mentioned material in the austenization temperature region is worked by hot-forging, for example, to prepare a steel article, and the thus prepared steel article is cooled from the austenization temperature region to a temperature of or lower than 300° C. at a cooling rate of from 2° to 100° C./second for the following reason. At a cooling rate of under 2° C./second, a sufficient hardening effect is unavailable and satisfactory toughness and strength cannot be imparted to the steel article. A cooling rate of over 100° C./second is, on the other hand, difficult to achieve industrially.

The reason why the lower limit value of the above-mentioned cooling rate should be limited to 2° C./second is described in more detail.

A steel bar made of steel (A) specified in Table 1 described later was heated to 1,250° C., and the steel bar in the austenization temperature region was hot-forged to prepare a plurality of test pieces. These test pieces were cooled from the austenization temperature region to 25° C. at different cooling rates. The relationship between the cooling rate of these test pieces and Charpy impact value at −40° C. (uE−40° C.) and tensile strength (TS) of these test pieces was investigated. The result is shown in FIG. 1.

With a cooling rate of under 2° C./second, as is clear from FIG. 1, while the Charpy impact value at −40° C. is over 10 kgf.m/cm$^2$ which is a target value of the present invention, the tensile strength is under 80 kgf/mm$^2$ which is a target value of the present invention.

Then, steel bars made of steel (C) and steel (D) specified in Table 3 described later were heated to 1,250° C., and each steel bar in the austenization temperature region was hot-forged to prepare a plurality of test pieces. These test pieces were cooled as in the case of the test pieces made of the above-mentioned steel (A). The relationship between the cooling rate of these test pieces and Charpy impact value at −40° C.(uE−40° C.) and tensile strength (TS) of these test pieces was also investigated. The result is shown in FIG. 2.

Figure 2:
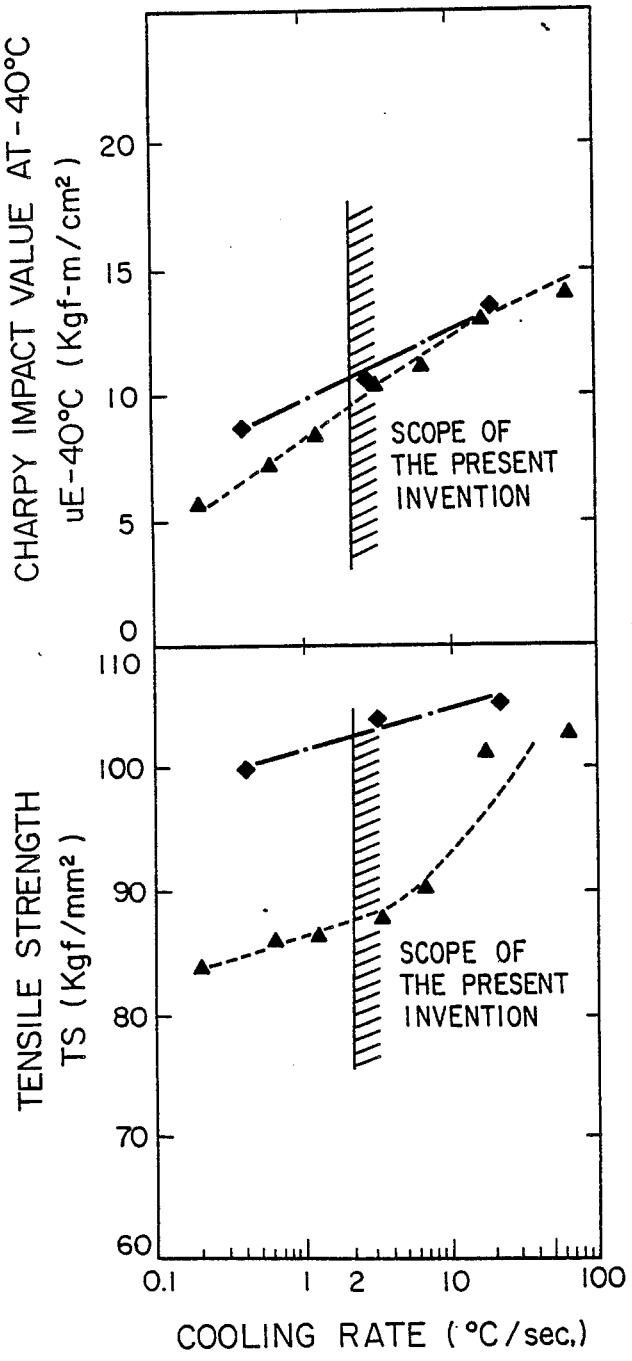
FIG. 2 is a graph illustrating the relationship between Charpy impact value at −40° C., tensile strength, and the cooling rate for test pieces made of steels (C) and (D).

In FIG. 2, the mark "▲" represents data on the test pieces made of steel (C), and the mark "◆", data on the test pieces made of steel (D).

As is clear from FIG. 2, a cooling rate of under 2° C./second results in a tensile strength of over the target value of the present invention of 80 kgf/mm², but in a Charpy impact value of under the target value of the present invention of 10 kgf.m/cm².

With a cooling rate of under 2° C./second, as described above, toughness and tensile strength do not exceed the target values of the present invention at the same time. In the present invention, therefore, the lower limit value of cooling rate of the steel article is limited to 2° C./second.

In the present invention, the cooling arrest temperature of the steel article is limited to a temperature of or lower than 300° C. for the following reason. With a cooling arrest temperature of over 300° C., a sufficient hardening effect is unavailable, and a high toughness and a high strength cannot be imparted to the steel article.

Now, the method for manufacturing the steel article of the present invention is described further in detail by means of examples.

EXAMPLE 1

Steel (A), within the scope of the present invention, having the chemical composition as shown in Table 1 was melted in a vacuum melting furnace, and the resultant molten steel was cast into an ingot of 150 kg. Then, a steel bar having a diameter of 90 mm was prepared from this ingot. The thus prepared steel bar was heated to 1,250° C., and the heated steel bar was hot-forged in the austenization temperature region to manufacture five front axle beams for automobile. The front axle beams were then cooled at cooling rates as shown in Table 2. Test pieces Nos. 1 to 5 were cut from the thus manufactured front axle beams to investigate mechanical properties of these test pieces.

Subsequently, a front axle beam for automobile was manufactured from steel (B), within the scope of the present invention, having the chemical composition as shown in Table 1, in the same manner as in the above-mentioned case of steel A. Test piece No. 6 was cut from the thus manufactured front axle beam, and mechanical properties of the test piece No. 6 was investigated.

The results of the investigation are altogether shown in Table 2.

TABLE 1

| Kind of steel | C | Si | Mn | P | S | Cr | V | Mn + Cr | Al | N |
|---|---|---|---|---|---|---|---|---|---|---|
| | (wt. %) | | | | | | | | | |
| A | 0.035 | 0.31 | 2.41 | 0.014 | 0.017 | 1.52 | 0.054 | 3.93 | 0.029 | 0.0043 |
| B | 0.048 | 0.52 | 1.37 | 0.016 | 0.019 | 2.45 | 0.120 | 3.82 | 0.033 | 0.0036 |

TABLE 2

| No. | Kind of steel | Cooling rate °C./sec | YS Kgf/mm² | TS Kgf/mm² | El % | RA % | uE-40° C. Kgf.m/cm² | uE25° C. Kgf.m/cm² |
|---|---|---|---|---|---|---|---|---|
| 1 | A | 0.6 (25° C.) | 55.4 | 77.8 | 24.8 | 70.5 | 13.8 | 20.6 |
| *2 | A | 3.5 (25° C.) | 63.5 | 84.1 | 22.5 | 68.8 | 15.0 | 21.4 |
| *3 | A | 25.0 (25° C.) | 77.0 | 94.3 | 20.0 | 70.2 | 23.6 | 24.8 |
| *4 | A | 70.2 (25° C.) | 78.5 | 96.5 | 19.7 | 69.8 | 23.9 | 25.2 |
| 5 | A | 22.9 (500° C.) | 58.7 | 79.3 | 24.4 | 69.3 | 12.6 | 19.6 |
| *6 | B | 16.2 (25° C.) | 76.8 | 93.2 | 20.4 | 69.6 | 21.7 | 24.0 |

In Table 2, the mark "*" contained in the column of No. represents a test piece of the present invention; absence of this mark, a test piece for comparison outside the scope of the present invention; temperature indicated in parentheses, a cooling arrest temperature; "YS", a yield strength; "TS", a tensile strength; "El", an elongation; "RA", a reduction of cross-section area; "uE−40° C.", a Charpy impact value at −40° C.; and "uE25° C.", a Charpy impact value at 25° C. Also in the following tables, these symbols have the same meanings as in Table 2.

As is clear from Table 2, all the test pieces of the present invention Nos. 2 to 4 and 6 have a Charpy impact value at −40° C. of at least 15 kgf.m/cm² and a tensile strength of at least 84 kgf/mm², thus showing a high toughness and a high strength. In contrast, the test piece for comparison No. 1, of which the cooling rate is outside the scope of the present invention, has a Charpy impact value at −40° C. and a tensile strength lower than those of any of the test pieces of the present invention. The test piece for comparison No. 5, of which the cooling arrest temperature is outside the scope of the present invention, shows a Charpy impact value at −40° C. and a tensile strength lower than those of any of the test pieces of the present invention.

EXAMPLE 2

A front axle beam for automobile was manufactured from each of steels (C), (D), (E) and (F), within the scope of the present invention, having the chemical composition as shown in Table 3, in the same manner as in Example 1. Test pieces Nos. 7 to 19 were cut from these front axle beams, and mechanical properties of these test pieces were investigated. The results are shown in Table 4.

TABLE 3

(wt. %)

| Kind of steel | C | Si | Mn | P | S | Cr | V | Mn + Cr | Ti | B | Al | N |
|---|---|---|---|---|---|---|---|---|---|---|---|---|
| C | 0.044 | 0.34 | 2.46 | 0.016 | 0.016 | 1.53 | 0.048 | 3.99 | 0.014 | 0.0012 | 0.033 | 0.0038 |
| D | 0.048 | 0.32 | 2.95 | 0.018 | 0.017 | 2.05 | 0.055 | 5.00 | 0.011 | 0.0015 | 0.030 | 0.0046 |
| E | 0.047 | 0.33 | 2.58 | 0.016 | 0.018 | 1.57 | 0.143 | 4.15 | 0.015 | 0.0011 | 0.031 | 0.0040 |
| F | 0.049 | 0.81 | 1.12 | 0.018 | 0.055 | 2.13 | 0.180 | 3.25 | 0.015 | 0.0010 | 0.027 | 0.0038 |

TABLE 4

| No. | Kind of steel | Cooling rate °C./sec | YS kgf/mm² | TS Kgf/mm² | El % | RA % | uE-40° C. kgf.m/cm² | uE25° C. kgf.m/cm² |
|---|---|---|---|---|---|---|---|---|
| 7 | C | 0.2 (25° C.) | 58.7 | 84.0 | 23.6 | 65.0 | 5.6 | 12.2 |
| 8 | C | 0.6 (25° C.) | 61.0 | 85.9 | 21.5 | 65.5 | 7.2 | 14.3 |
| 9 | C | 1.2 (25° C.) | 62.3 | 86.2 | 21.3 | 65.5 | 8.4 | 14.9 |
| *10 | C | 3.2 (25° C.) | 63.8 | 87.7 | 20.4 | 65.9 | 10.4 | 16.8 |
| *11 | C | 6.5 (25° C.) | 65.0 | 90.1 | 20.3 | 65.3 | 11.2 | 17.7 |
| *12 | C | 18.2 (25° C.) | 82.1 | 101.3 | 19.2 | 65.2 | 13.1 | 18.0 |
| *13 | C | 62.3 (25° C.) | 82.5 | 103.0 | 19.0 | 65.0 | 14.0 | 20.3 |
| 14 | C | 17.7 (400° C.) | 61.6 | 87.9 | 20.8 | 65.7 | 9.0 | 15.7 |
| 15 | D | 0.4 (25° C.) | 70.8 | 99.8 | 19.3 | 57.2 | 8.7 | 13.8 |
| *16 | D | 3.0 (25° C.) | 71.8 | 103.9 | 19.1 | 57.0 | 10.5 | 15.0 |
| *17 | D | 20.4 (25° C.) | 72.7 | 105.1 | 18.7 | 57.4 | 13.5 | 15.6 |
| *18 | E | 14.3 (25° C.) | 84.5 | 106.2 | 19.0 | 64.2 | 12.7 | 18.8 |
| *19 | F | 15.2 (25° C.) | 79.8 | 98.0 | 19.2 | 65.2 | 13.3 | 20.0 |

As is clear from Table 4, all the test pieces of the present invention Nos. 10 to 13 and 16 to 19 have a Charpy impact value at −40° C. of at least 10 kgf.m/cm² and a tensile strength of at least 87 kgf/mm², thus showing a high toughness and a high strength. In contrast, the test pieces for comparison Nos. 7 to 9, of which the cooling rate is outside the scope of the present invention, have a Charpy impact value at −40° C. and a tensile strength lower than those of any of the test pieces of the present invention. The test piece for comparison No. 14, of which the cooling arrest temperature is outside the scope of the present invention, though having a tensile strength not so low, shows a Charpy impact value at −40° C. lower than that of any of the test pieces of the present invention. The test piece for comparison No. 15, of which the cooling rate is outside the scope of the present invention, though having a high tensile strength, shows a Charpy impact value at −40° C. lower than that of any of the test pieces of the present invention.

EXAMPLE 3

A front axle beam for automobile was manufactured from each of steels (G), (H), (I), (J) and (K), within the scope of the present invention, having the chemical composition as shown in Table 5, in the same manner as in Example 1. Test pieces Nos. 20 to 24 were cut from these front axle beams, and mechanical properties of these test pieces were investigated. The results are shown in Table 6.

TABLE 5

(wt. %)

| Kind of steel | C | Si | Mn | P | S | Cr | V | Mn + Cr | Ti | B | Ni | Cu | Mo | Nb | Al | N |
|---|---|---|---|---|---|---|---|---|---|---|---|---|---|---|---|---|
| G | 0.025 | 0.30 | 2.51 | 0.017 | 0.018 | 1.22 | 0.150 | 3.73 | 0.012 | 0.0013 | 0.60 | — | — | — | 0.025 | 0.0042 |
| H | 0.045 | 0.33 | 1.58 | 0.017 | 0.019 | 1.62 | 0.150 | 3.20 | 0.013 | 0.0013 | — | 0.65 | — | — | 0.028 | 0.0030 |
| I | 0.024 | 0.34 | 2.39 | 0.019 | 0.019 | 1.05 | 0.098 | 3.44 | 0.014 | 0.0014 | — | — | 0.25 | 0.030 | 0.029 | 0.0033 |
| J | 0.035 | 0.32 | 2.63 | 0.017 | 0.020 | 1.15 | 0.060 | 3.78 | 0.015 | 0.0012 | 0.35 | 0.38 | — | — | 0.030 | 0.0035 |
| K | 0.022 | 0.33 | 1.62 | 0.018 | 0.019 | 1.59 | 0.103 | 3.21 | 0.012 | 0.0009 | 0.42 | 0.30 | 0.15 | 0.022 | 0.025 | 0.0038 |

TABLE 6

| No. | Kind of steel | Cooling rate °C./sec | YS kgf/mm² | TS kgf/mm² | El % | RA % | uE-40° C. kgf.m/cm² | ue25° C. kgf.m/cm² |
|---|---|---|---|---|---|---|---|---|
| *20 | G | 17.8 | 81.1 | 98.6 | 20.3 | 66.9 | 15.8 | 21.1 |
| *21 | H | 15.1 | 81.7 | 99.2 | 20.0 | 66.3 | 15.2 | 22.6 |
| *22 | I | 12.8 | 82.2 | 104.8 | 19.3 | 65.8 | 13.2 | 19.4 |
| *23 | J | 16.1 | 82.4 | 101.7 | 19.5 | 65.8 | 14.4 | 18.3 |
| *24 | K | 14.4 | 80.3 | 99.1 | 21.2 | 67.9 | 13.3 | 20.3 |

As is clear from Table 6, the test pieces of the present invention Nos. 20 to 24 have a Charpy impact value at −40° C. of at least 13 kgf.m/cm² and a tensile strength of at least 98 kgf/mm², thus showing a high toughness and a high strength.

Now, examples for comparison of the present invention are further described.

EXAMPLES FOR COMPARISON

A front axle beam for automobile was manufactured from each of steels (L), (M), (N), (O), (P) and (Q), outside the scope of the present invention, having the chemical composition as shown in Table 7, in the same manner as in Example 1. Test pieces Nos. 25 to 30 were cut from these front axle beams, and mechanical properties of these test pieces were investigated. The results are shown in Table 8.

TABLE 7

(wt. %)

| Kind of steel | C | Si | Mn | P | S | Cr | V | Mn + Cr | Ti | B | Al | N |
|---|---|---|---|---|---|---|---|---|---|---|---|---|
| L | 0.077 | 0.30 | 1.89 | 0.016 | 0.019 | 1.55 | 0.077 | 3.44 | — | — | 0.025 | 0.0039 |
| M | 0.096 | 0.41 | 1.26 | 0.017 | 0.020 | 2.34 | 0.103 | 3.60 | — | — | 0.033 | 0.0040 |
| N | 0.115 | 0.40 | 1.72 | 0.018 | 0.026 | 1.65 | — | 3.37 | 0.020 | 0.0019 | 0.022 | 0.0032 |
| O | 0.135 | 0.33 | 0.96 | 0.010 | 0.016 | 1.42 | — | 2.38 | 0.020 | 0.0021 | 0.024 | 0.0027 |
| P | 0.042 | 0.52 | 0.92 | 0.017 | 0.018 | 1.52 | 0.120 | 2.44 | — | — | 0.023 | 0.0042 |
| Q | 0.040 | 0.40 | 0.88 | 0.016 | 0.018 | 1.35 | 0.072 | 2.23 | 0.017 | 0.0015 | 0.025 | 0.0030 |

TABLE 8

| No. | Kind of steel | Cooling rate °C./sec | YS kgf/mm² | TS kgf/mm² | El % | RA % | uE-40° C. kgf.m/cm² | ue25° C. kgf.m/cm² |
|---|---|---|---|---|---|---|---|---|
| 25 | L | 17.1 | 75.6 | 91.9 | 20.4 | 68.8 | 8.5 | 12.1 |
| 26 | M | 15.4 | 74.2 | 92.2 | 20.7 | 69.4 | 7.8 | 11.2 |
| 27 | N | 7.2 | 74.2 | 105.2 | 17.5 | 47.2 | 6.4 | 12.1 |
| 28 | O | 9.3 | 65.0 | 91.4 | 19.5 | 58.5 | 4.3 | 9.8 |
| 29 | P | 7.6 | 45.3 | 66.7 | 31.7 | 2.4 | 6.8 | 15.9 |
| 30 | Q | 10.4 | 47.5 | 69.1 | 31.3 | 72.1 | 5.0 | 14.4 |

As is clear from Table 8, for the test pieces for comparison Nos. 25 to 28, a high tensile strength of over 90 kgf/mm² was obtained because of the high carbon content outside the scope of the present invention, whereas the Charpy impact value at −40° C. was lower than 10 kgf.m/cm² which was the target of the present invention. The test pieces for comparison Nos. 29 and 30, which had a low total amount of Manganese and Chromium outside the scope of the present invention, showed a low Charpy impact value at −40 ° C. and a low tensile strength.

According to the method of the present invention, as described above in detail, it is possible to manufacture a steel article having a high toughness and a high strength, thus providing industrially useful effects.

What is claimed is:

1. A method for manufacturing a steel article having a high toughness and a high strength, said steel article having a Charpy impact value at 25° C. (uE25° C.) of at least 15.0 kgf.m/cm² and a Charpy impact value at −40° C. (UE−40 ° C.) of at least 10 kgf.m/cm² and having a yield strength (YS) of at least 60 kgf/mm² and a tensile strength (TS) of at least 80 kgf/mm² comprising providing a material comprising:

carbon: 0.020 to 0.049 wt. %, silicon: 0.10 to 1.00 wt. %, manganese: 1.00 to 3.50 wt. %, chromium: 0.50 to 3.50 wt. %, the total amount of said manganese and said chromium being: 2.50 to 6.00 wt. %, vanadium: 0.02 to 0.20 wt. %, aluminum: 0.01 to 0.05 wt. %. and the balance being iron and incidental impurities, the amount of nitrogen as one of said incidental impurities being up to 0.006 wt. %;

heating said material to an austenization temperature sufficient so that said steel article will have said high toughness and said high strength;

hot-working said material at an austenization temperature to prepare a steel article; and cooling said steel article thus prepared from an austenization temperature to a temperature of or lower than 300° C. at a cooling rate of from 2 to 100° C./second, thereby imparting said high toughness and said high strength to said steel article.

2. The method as claimed in claim 1, wherein:

said material additionally contains the following elements:

boron: from 0.0003 to 0.0030 wt. %, and titanium: from 0.005 to 0.030 wt. %.

3. The method as claimed in claim 2, wherein:

said material additionally contains at least one element selected from the group consisting of:

nickel: from 0.05 to 1.00 wt. %, copper: from 0.05 to 1.00 wt. %, molybdenum: from 0.05 to 0.50 wt. %, and niobium: from 0.005 to 0.050 wt. %.

4. The method as claimed in claim 1, wherein said material is heated to an austenizing temperature of at least 1100° C. so that said steel article will have said high toughness and said high strength.

5. The method as claimed in claim 2, wherein said material is heated to an austenizing temperature of at least 1100° C. so that said steel article will have said high toughness and said high strength.

6. The method as claimed in claim 3, wherein said material is heated to an austenizing temperature of at least 1100° C. so that said steel article will have said high toughness and said high strength.

7. The method as claimed in claim 1, wherein said material is heated to an austenizing temperature of 1250° C.

8. The method as claimed in claim 2, wherein said material is heated to an austenizing temperature of 1250° C.

9. The method as claimed in claim 3, wherein said material is heated to an austenizing temperature of 1250° C.

* * * * *